US008894261B2

(12) United States Patent
Chen

(10) Patent No.: US 8,894,261 B2
(45) Date of Patent: Nov. 25, 2014

(54) LED CANDLE LAMP WITH FLAME LIGHTING EFFECTS

(71) Applicant: Tse Min Chen, Hsinchu (TW)

(72) Inventor: Tse Min Chen, Hsinchu (TW)

( * ) Notice: Subject to any disclaimer, the term of this patent is extended or adjusted under 35 U.S.C. 154(b) by 164 days.

(21) Appl. No.: 13/776,825

(22) Filed: Feb. 26, 2013

(65) Prior Publication Data

US 2014/0241004 A1 Aug. 28, 2014

(51) Int. Cl.

| | |
|---|---|
| ***F21V 35/00*** | (2006.01) |
| ***F21S 10/04*** | (2006.01) |
| ***F21S 6/00*** | (2006.01) |
| *F21S 9/02* | (2006.01) |
| *F21W 121/00* | (2006.01) |
| *F21Y 101/02* | (2006.01) |

(52) U.S. Cl.

CPC ..... *F21S 10/04* (2013.01); *F21S 6/001* (2013.01); *F21S 9/02* (2013.01); *F21W 2121/00* (2013.01); *F21Y 2101/02* (2013.01); *Y10S 362/81* (2013.01)

USPC ..... 362/569; 362/392; 362/810

(58) Field of Classification Search

CPC ..... F21S 10/04; F21S 9/02; F21S 10/046; F21S 10/005; F21W 2121/002; Y10S 362/81; Y10S 362/80; F21V 35/00

USPC ..... 362/569, 392, 810

See application file for complete search history.

*Primary Examiner* — William Carter

(74) *Attorney, Agent, or Firm* — Jackson IPG PLLC

(57) ABSTRACT

A LED candle lamp by controlling the coil to generate a magnetic attractive force to attract the magnet set, the translucent flame-shaped blade is vibrated when the emitted light of the LED lamp is guided by the light guide tube toward the blame-shaped blade body of the translucent flame-shaped blade, causing flame lighting effects. Subject to the arrangement that two magnets of a magnet set are bonded together by an adhesive with the same magnet poles thereof abutted against each other, magnetic field lines can be compressed into a dish, enhancing the effects of magnetic attraction and oscillation of a translucent flame-shaped blade.

4 Claims, 6 Drawing Sheets

LED CANDLE LAMP WITH FLAME LIGHTING EFFECTS

BACKGROUND OF THE INVENTION

1. Field of the Invention

The present invention relates to LED candle lamps and more particularly, to a LED candle lamp with flame lighting effects, which uses a coil to attract a magnet set, causing vibration of a translucent flame-shaped blade during emission of light by a LED lamp toward the translucent flame-shaped blade, and therefore the LED candle lamp can cause desired flame lighting effects.

2. Description of the Related Art

The prior flame device discloses an apparatus creating a flickering flame effect. However, the installation of the lens requires very high precision to assure accurate projection of light; the center of the coil must maintain a particular relationship with the light guide plate to achieve the expected flickering flame effect. If the sizes of the component parts are not perfectly accurate during fabrication, waste products can be produced, lowering the yield. Further, the cost of these component parts is high, and their installation and calibration requires much labor and time.

SUMMARY OF THE INVENTION

The present invention has been accomplished under the circumstances in view. It is therefore the main object of the present invention to provide a LED candle lamp with flame lighting effects, which, subject to the arrangement that two magnets of a magnet set are bonded together by an adhesive with the same magnet poles thereof abutted against each other, magnetic field lines can be compressed into a dish, enhancing the effects of magnetic attraction and oscillation of a translucent flame-shaped blade.

It is another object of the present invention to provide a LED candle lamp with flame lighting effects, which allows quick installation of a coil without aiming it at the center of a light guide tube or the center of a translucent flame-shaped blade, facilitating fabrication and assembly and improving the yield rate.

It is still another object of the present invention to provide a LED candle lamp with flame lighting effects, which has a simple structure and can be easily assembled with less labor and in less time, saving the cost and increasing product competivity.

DETAILED DESCRIPTION OF THE INVENTION

Figure 1:
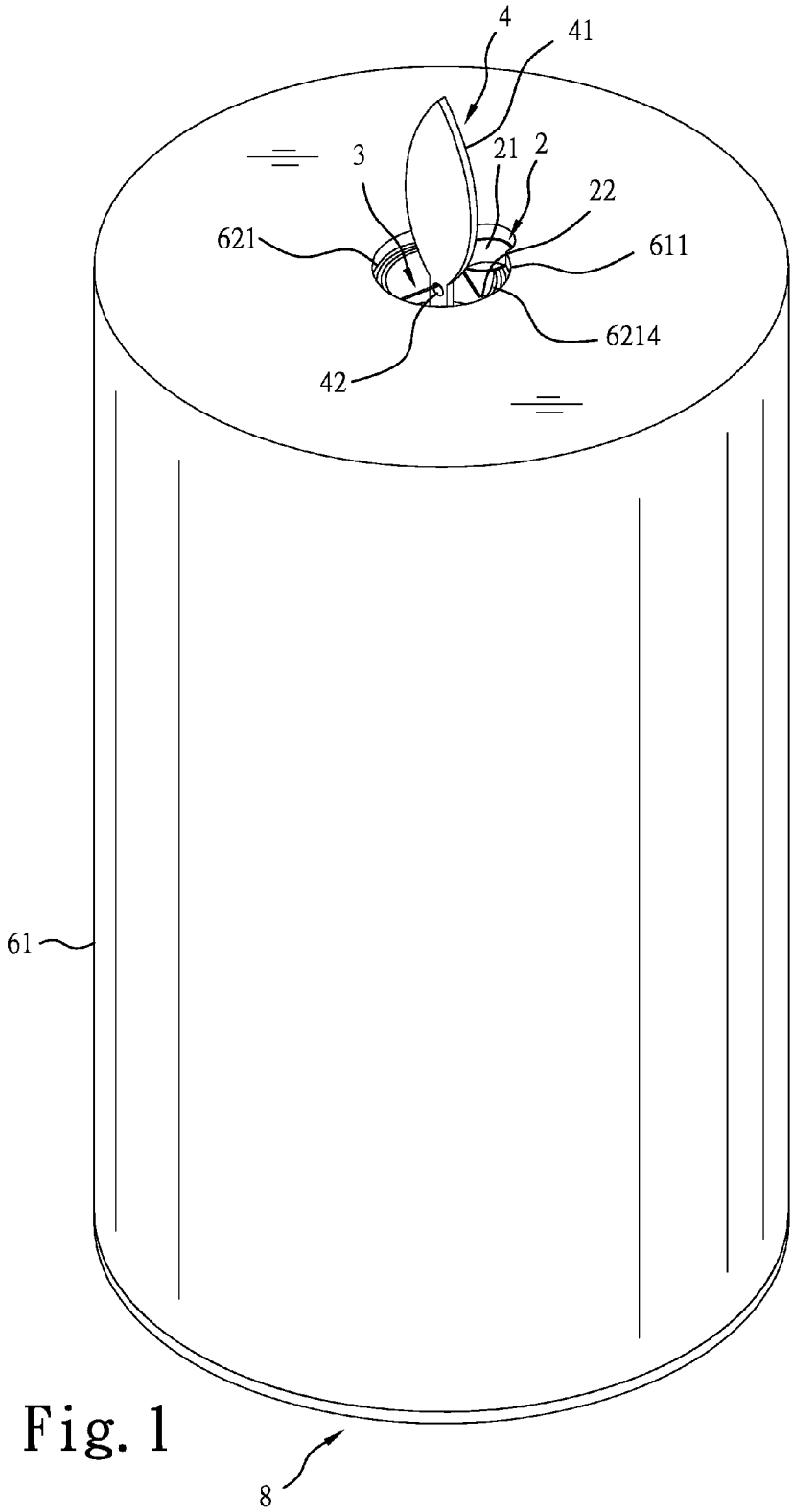
FIG. 1 is an elevational view of a LED candle lamp with flame lighting effects in accordance with the present invention.
Figure 2:
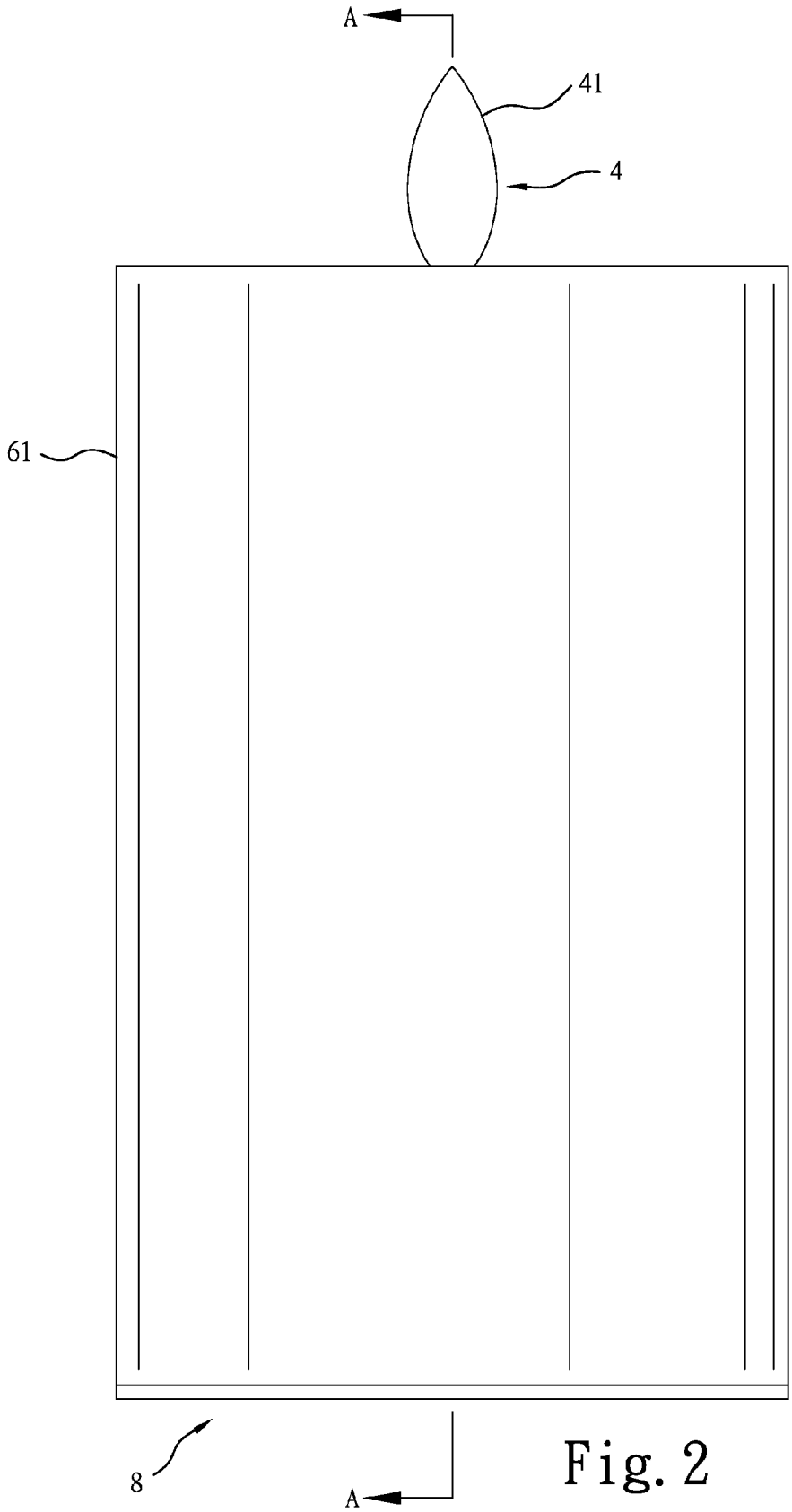
FIG. 2 is a plain view of the LED candle lamp with flame lighting effects in accordance with the present invention.
Figure 3:
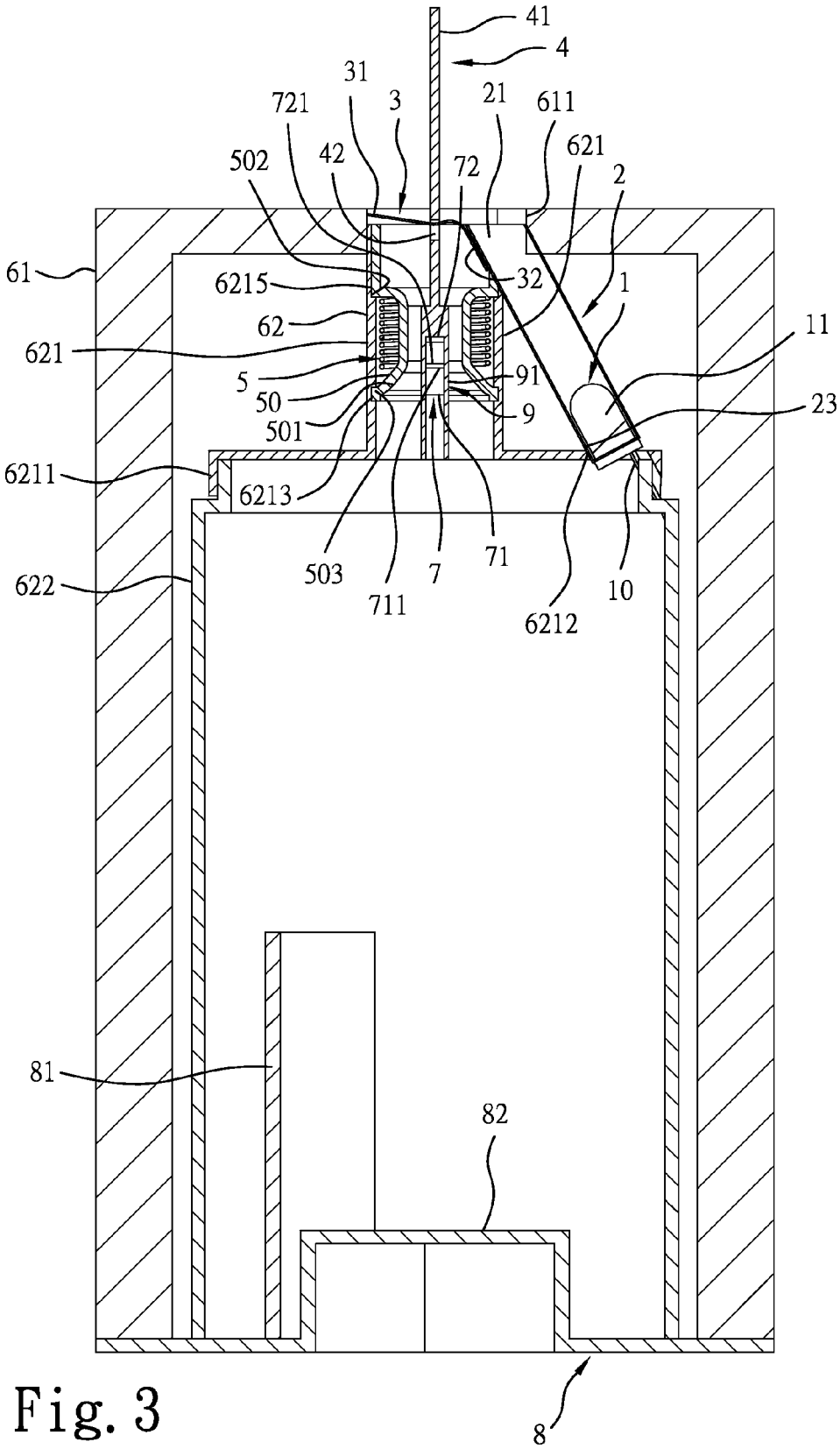
FIG. 3 is a sectional view taken along line A-A of FIG. 2.
Figure 4:
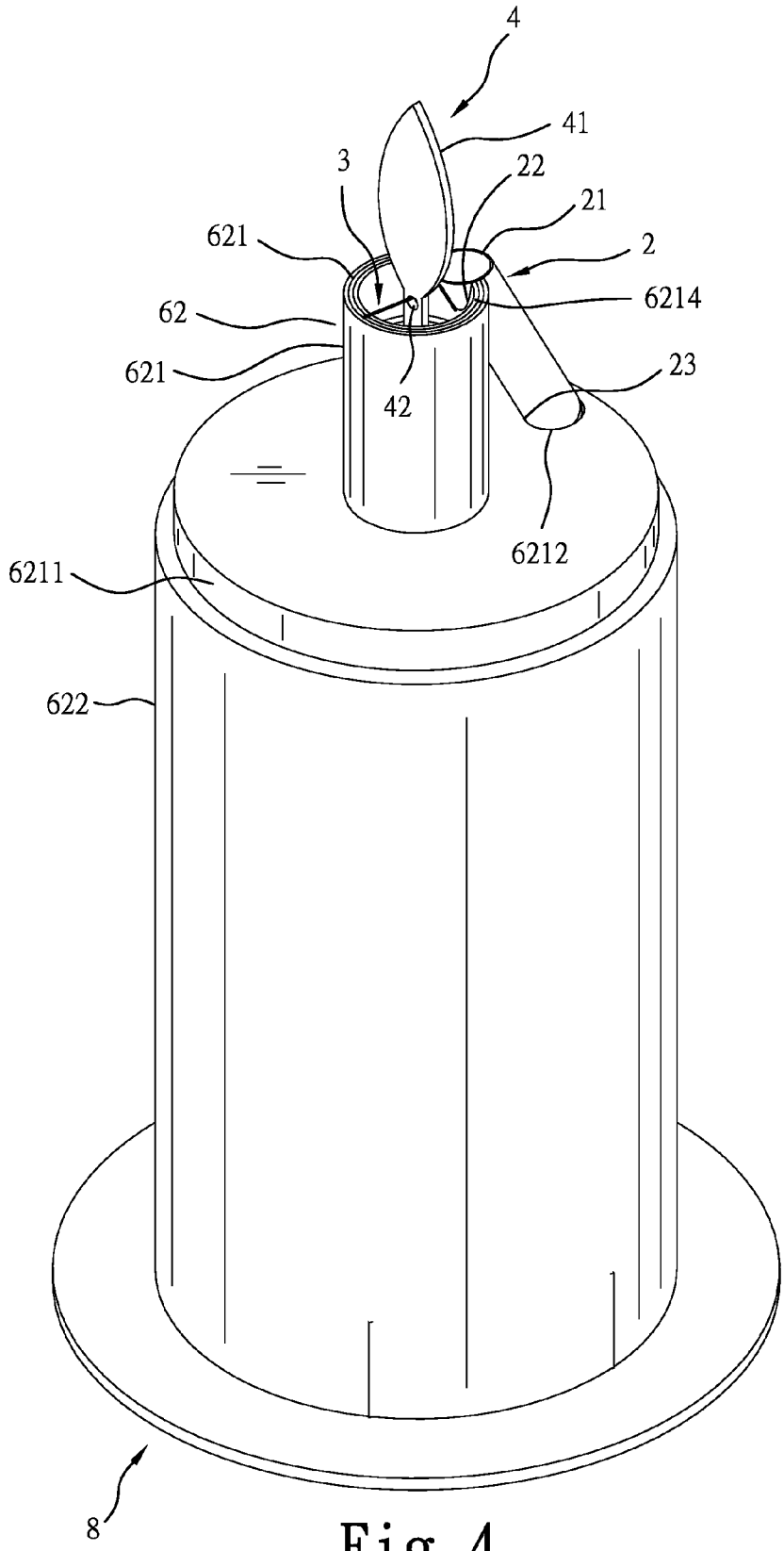
FIG. 4 is an elevational view of the present invention, illustrating the status of the LED candle lamp with flame lighting effects after removal of the housing.
Figure 5:
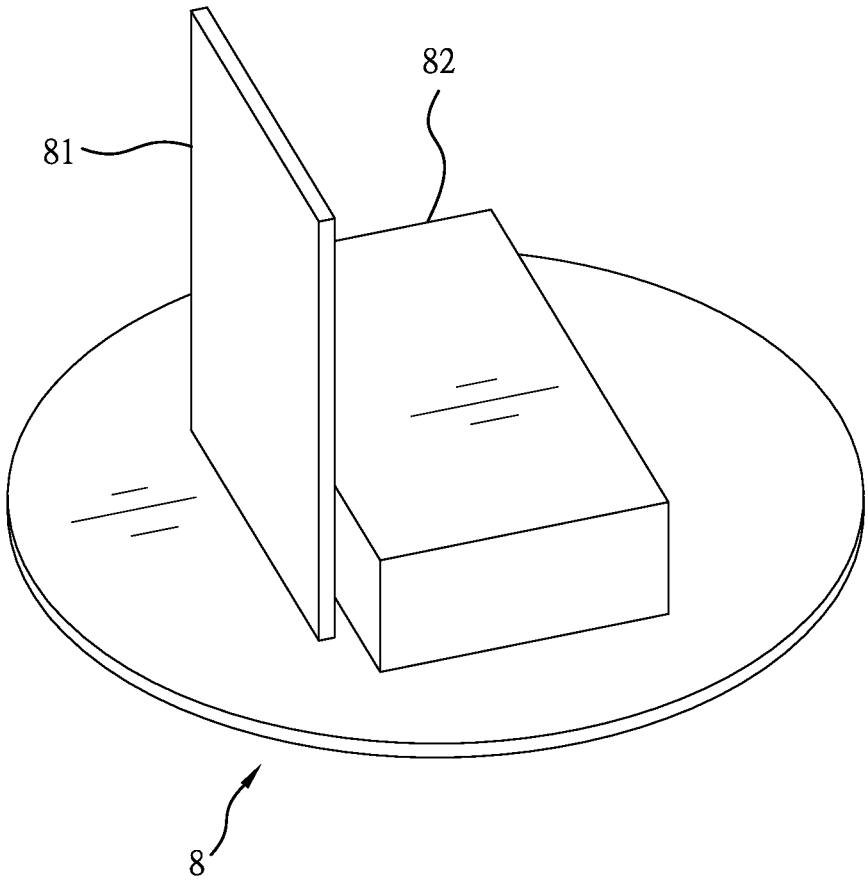
FIG. 5 is an elevational view of a part of the present invention, illustrating the arrangement of the base member, the control circuit board and the battery pack.
Figure 6:
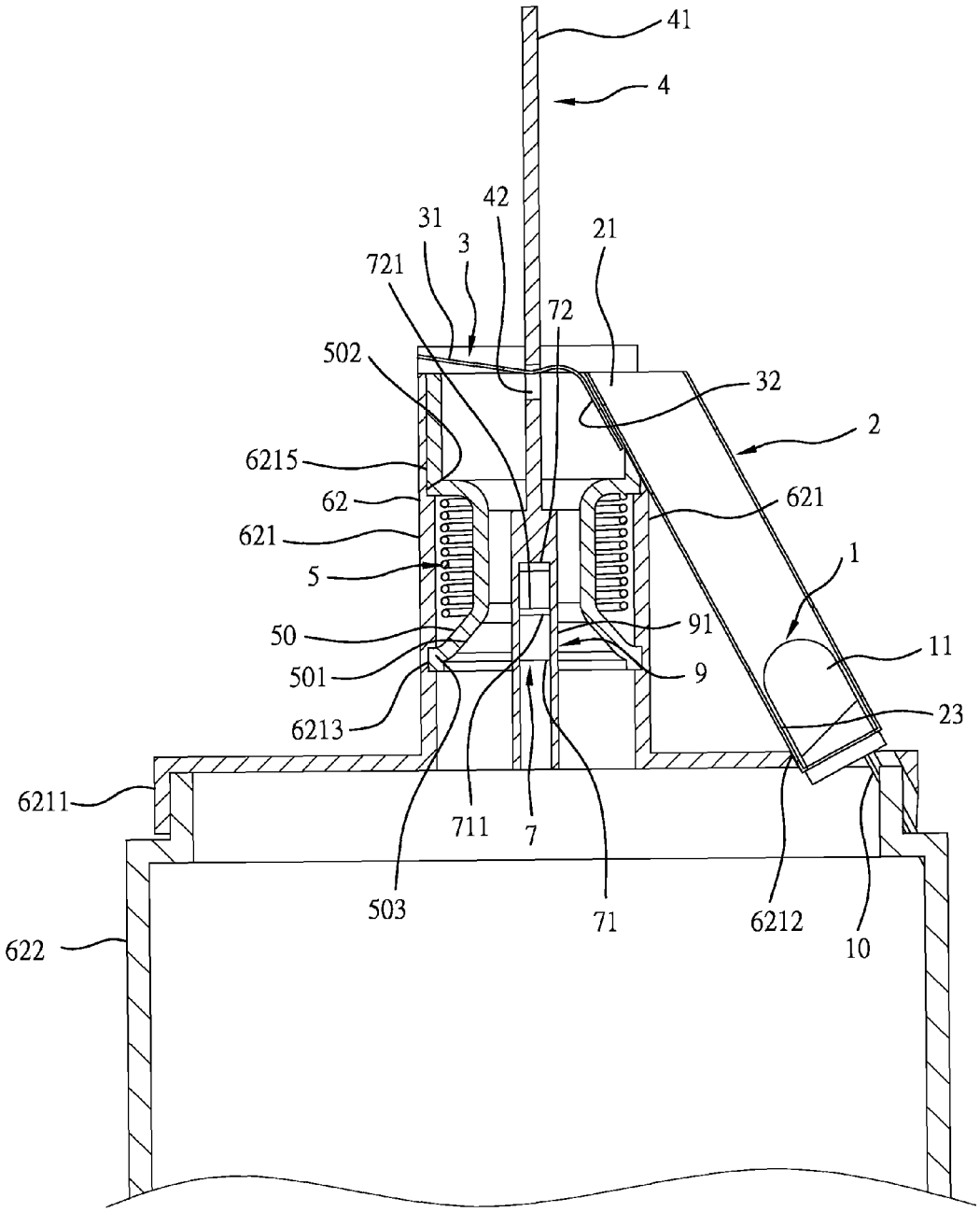
FIG. 6 is a sectional view taken along line A-A of FIG. 2.

Referring to FIGS. 1-6, a LED candle lamp with flame lighting effects in accordance with the present invention is shown comprising:

a LED lamp 1 having conducting pins 10 thereof electrically coupled to a control circuit board 81 (see FIG. 3) by lead wires (not shown) and LED lamp body 11 thereof inserted into a light guide tube 2;

a light guide tube 2 obliquely mounted around the LED lamp 1 and adapted to guide the emitted light from the LED lamp 1 out of a top opening 21 thereof toward a translucent flame-shaped blade 4;

a support member 3 having its one end 31 connected to a candle lamp housing 61 (see FIG. 3 and FIG. 6) or wick holder shell 62, and its other end 32 inserted through the translucent flame-shaped blade 4 and then connected to the light guide tube 2, holding the translucent flame-shaped blade 4 in a movable condition;

a translucent flame-shaped blade 4 mounted with a bottom side thereof in the wick holder shell 62 and having a flame-shaped blade body 41 located at a top side thereof and suspending above the wick holder shell 42 and a pivot hole 42 located on the middle for the passing of the support member 3;

a magnet holder 9 affixed to the bottom side of the translucent flame-shaped blade 4 and defining therein a locating groove 91;

a magnet set 7 mounted in the locating groove 91 of the magnet holder 9 at the bottom side of the translucent flame-shaped blade 4 and comprising two magnets 71; 72 that are bonded together by an adhesive with the same magnet poles 711; 721 thereof abutted against each other;

a coil support bracket 50 fixedly mounted in the wick holder shell 62 and defining a middle neck portion 501 above the elevation of the magnet set 7, an expanded top positioning portion 502 and an expanded bottom ring portion 503;

a coil 5 wound round the neck portion 501 of the coil support bracket 50;

a wick holder shell 62 comprising an upper shell body 621 having an expanded lower part 6211, a lower shell body 622 connected to the expanded lower part 6211 of the upper shell body 621, an upper locating notch 6214 (see FIG. 4) located at the top side of the upper shell body 621 for supporting a peripheral part 22 of the light guide tube 2, a lower locating notch 6212 located at the expanded lower part 6211 of the upper shell body 621 (see FIG. 3 and FIG. 4) for supporting a lower part 23 of the light guide tube 2 to keep the light guide tube 2 in a tilted position, an inside annular groove 6213 formed in the inside wall of the upper shell body 621 for the positioning of the expanded bottom ring portion 503, and a top positioning groove 6215 located in the top side of the upper shell body 621 for the positioning of the expanded top positioning portion 502 of the coil support bracket 50;

a base member 8 fastened to the bottom side of the lower shell body 622 of the wick holder shell 62 and the bottom side of the candle lamp housing 61;

a control circuit board 81 mounted at the base member 8 and electrically coupled with the LED lamp 1 and the coil 5 for controlling the LED lamp 1 to emit light and the coil 5 to produce a magnetic field;

a battery pack 82 mounted at the base member 8 and electrically coupled to the control circuit board 81 to provide the control circuit board 81, the LED lamp 1 and the coil 5 with the necessary working voltage; and a candle lamp housing 61 covering the wick holder shell 62 and defining a top through hole 611 through which the flame-shaped blade body 41 of the translucent flame-shaped blade 4 extends to the outside of the candle lamp housing 61 without blocking the top opening 21 of the light guide tube 2.

When the coil 5 is electrically conducted, it produces a magnetic field to attract the magnet set 7, causing the translucent flame-shaped blade 4 to vibrate. At the same time, the LED lamp 1 is controlled to emit light through the light guide tube 2 toward the translucent flame-shaped blade 4, producing flame lighting effects.

In conclusion, the invention provides a LED candle lamp with flame lighting effects, which has advantages and features as follows:

1. Subject to the arrangement that the two magnets 71; 72 of the magnet set 7 are bonded together by an adhesive with the same magnet poles 711; 721 thereof abutted against each other, magnetic field lines can be compressed into a dish, enhancing the effects of magnetic attraction.
2. Installation of the coil 5 needs not to aim the coil 5 at the center of the light guide tube 2 or the center of the translucent flame-shaped blade 4, facilitating fabrication and assembly. Further, because precision is less critical, the yield rate can be relatively improved.
3. The LED candle lamp with flame lighting effects has a simple structure and can be easily assembled with less labor and in less time, saving the cost and increasing product competivity.

What is claimed is:

1. A light emitting diode (LED) candle lamp with flame lighting effects, comprising;

a LED lamp;

a light guide tube surrounding said LED lamp in a tilted position and adapted to guide light rays emitted by said LED lamp out of a top opening thereof toward a translucent flame-shaped blade;

a support member having one end thereof selectively connectable to a candle lamp housing and a wick holder shell and an opposite end thereof inserted through a translucent flame-shaped blade and connected to said light guide tube;

a translucent flame-shaped blade having a bottom side thereof mounted in said wick holder shell, a top side thereof forming a flame-shaped blade body and suspending above said wick holder shell and a pivot hole located on a middle part thereof or the passing of said support member;

a magnet set mounted at the bottom side of said translucent flame-shaped blade, said magnet set comprising two magnets bonded together by an adhesive, said two magnets having same magnet poles thereof abutted against each other;

a coil mounted in said wick holder shell and disposed above an elevation of said magnet set;

said wick holder shell comprising an upper shell body having an expanded lower part, a lower shell body connected to said expanded lower part of said upper shell body, an upper locating notch located at a top side of said upper shell body for supporting a peripheral part of said light guide tube, a lower locating notch located at said expanded lower part of said upper shell body for supporting a lower part of said light guide tube to keep said light guide tube in said tilted position;

a base member fastened to a bottom side of said lower shell body of said wick holder shell and a bottom side of a candle lamp housing and holding a control circuit board;

a battery pack mounted at said base member and electrically coupled to said control circuit board to provide said control circuit board, said LED lamp and said coil with the necessary working voltage; and a candle lamp housing covering said wick holder shell, said candle lamp housing defining a top through hole for the passing of said flame-shaped blade body of said translucent flame-shaped blade.

2. The LED candle lamp with flame lighting effects as claimed in claim 1, further comprising a magnet holder affixed to the bottom side of said translucent flame-shaped blade and defining therein a locating groove to accommodate said magnet set.

3. The LED candle lamp with flame lighting effects as claimed in claim 1, further comprising a coil support bracket fixedly mounted in said wick holder shell, said coil support bracket comprising a middle neck portion disposed above the elevation of said magnet set and supporting said coil, an expanded top positioning portion and an expanded bottom ring portion; said wick holder shell further comprises an inside annular groove formed in an inside wall of said upper shell body for receiving said expanded bottom ring portion of said coil support bracket, and a top positioning groove located in the top side of said upper shell body for the positioning of said expanded top positioning portion of said coil support bracket.

4. The LED candle lamp with flame lighting effects as claimed in claim 1, wherein said control circuit board is electrically coupled with said LED lamp and said coil for controlling said LED lamp to emit light and said coil to produce a magnetic field.

* * * * *